US006642900B2

(12) United States Patent
Bhattacharyya et al.

(10) Patent No.: US 6,642,900 B2
(45) Date of Patent: Nov. 4, 2003

(54) HIGH RADIATION EFFICIENT DUAL BAND FEED HORN

(75) Inventors: Arun Bhattacharyya, El Segundo, CA (US); Daniel H. Roper, Redondo Beach, CA (US)

(73) Assignee: The Boeing Company, Chicago, IL (US)

( * ) Notice: Subject to any disclaimer, the term of this patent is extended or adjusted under 35 U.S.C. 154(b) by 23 days.

(21) Appl. No.: 09/957,954

(22) Filed: Sep. 21, 2001

(65) Prior Publication Data

US 2003/0058182 A1 Mar. 27, 2003

(51) Int. Cl.[7] ..... H01Q 13/02
(52) U.S. Cl. ..... 343/786
(58) Field of Search ..... 343/786, 772; 333/21 A

(56) References Cited

U.S. PATENT DOCUMENTS

| | | | | |
|---|---|---|---|---|
| 3,510,875 A | | 5/1970 | Beguin | |
| 3,680,145 A | | 7/1972 | Beguin | |
| 3,821,741 A | | 6/1974 | D'Oro et al. | |
| 4,122,446 A | | 10/1978 | Hansen | |
| 4,442,437 A | | 4/1984 | Chu et al. | |
| 4,764,775 A | | 8/1988 | Craven | |
| 4,792,814 A | | 12/1988 | Ebisui | |
| 5,617,108 A | * | 4/1997 | Silinsky et al. | 343/786 |
| 5,907,309 A | | 5/1999 | Anderson et al. | |
| 6,137,450 A | | 10/2000 | Bhattacharyya et al. | |
| 6,163,304 A | | 12/2000 | Peebles et al. | |
| 6,208,309 B1 | | 3/2001 | Chandler et al. | |
| 6,208,310 B1 | | 3/2001 | Suleiman et al. | |

* cited by examiner

*Primary Examiner*—Michael C. Wimer
(74) *Attorney, Agent, or Firm*—Terje Gudmestad

(57) ABSTRACT

A multiple mode feed horn is provided for transmitting and receiving signals. The feed horn includes a transverse electric throat section, a transverse electric profile section, and a transverse electric aperture section. The transverse electric profile section propagates a first transverse electric (TE) mode. The transverse electric aperture section propagates a second TE mode. The multiple mode feed horn prevents propagation of traverse magnetic modes from said throat section to said aperture section.

19 Claims, 3 Drawing Sheets

HIGH RADIATION EFFICIENT DUAL BAND FEED HORN

TECHNICAL FIELD

The present invention relates generally to satellite communication systems, and more particularly to a high radiation efficient dual band feed horn for transmitting and receiving signals that are excited by multiple transverse electric modes.

BACKGROUND OF THE INVENTION

Conventional high efficiency feed horns are very useful as elements in phased array antenna and also as feed elements in a multi-beam reflector, in satellite communication systems. A multiple beam reflector has several feed elements that are used for receiving and transmitting multiple beams. Feed horn size is restricted because of the number of feed elements and required beam spacing. A phased array antenna with high efficiency feed horn elements requires 20% less elements, for a desired gain requirement, than that of corrugated feed horns or potter horns that usually have aperture efficiencies of about 70%. The reduction in feed horn elements reduces manufacturing costs, size, and weight of the phased array antenna.

A low efficiency feed horn yields less amplitude taper to a reflector edge for a given feed horn aperture size, which causes high side lobes and spill over loss. High side lobes are not desirable as they cause signal interference between beams. A conventional high efficiency feed horn minimizes spillover loss and interference problems due to its improved edge taper.

Corrugated horns have a disadvantage of a rim, which reduces usable aperture in cases where horn size is limited as with multi-beam antenna. The traditional corrugated horns are therefore not suitable for multi-beam antenna. Antenna packaging is a large driver in designing of multi-spot beam antennas.

Although the high efficiency horns are useful for many applications, they suffer from a limited bandwidth problem. The bandwidth of such feed horns is generally less than 10%. Therefore, separate transmit and receive antennas are required which take up more space and increase costs. Two different phased arrays are used in a phased array antenna, one for a transmitting band and one for a receiving band.

Since feed horn bandwidth decreases as aperture size increases, traditional reflector antennas must limit the horn size. This forces the main reflector aperture to be large in order to minimize spillover loss. Also, large focal lengths are needed to improve scanning performance, which further drives the reflector size to be large.

The above-described problems associated with traditional feed horns result in a trade-off between generally three alternatives; using two single band feed horns, using a dual band feed horn that is large in size relative to single band feed horns, or using a smaller sized dual band feed horn that suffers from interference problems and large spillover loss, which results in poor efficiency.

Additionally, all of the above mentioned feed horns also propagate both transverse electric (TE) modes and transverse magnetic (TM) modes. The propagation of both TE and TM modes further reduces the efficiency of a feed horn.

Therefore, it would be desirable to provide an improved feed horn design that supports dual bands, is smaller in size relative to conventional dual band feed horns, and operates at efficiency levels at least as high as that of conventional high efficiency feed horns with good cross-polarization level.

SUMMARY OF THE INVENTION

The foregoing and other advantages are provided by an apparatus for transmitting and receiving signals that are excited by multiple transverse electric modes. A multiple mode feed horn is provided for transmitting and receiving signals. The feed horn includes a transverse electric throat section, a transverse electric profile section, and a transverse electric aperture section. The transverse electric profile section propagates a first transverse electric (TE) mode. The transverse electric aperture section propagates a second TE mode. The multiple mode feed horn prevents propagation of traverse magnetic (TM) modes from said throat section to said aperture section.

One of several advantages of the present invention is that it is relatively small compared to traditional dual band corrugated feed horns. The decrease in size decreases the amount of material used to manufacture the feed horn, which decreases costs and weight of the feed horn.

Another advantage of the present invention is that it propagates transverse electric modes and minimizes propagation of TM modes, thereby providing a feed horn with an operating efficiency greater than that of traditional potter horns.

Furthermore, the present invention provides a dual band feed horn that has good return loss, good cross-polarization, and a desirable radiation pattern.

The present invention itself, together with further objects and attendant advantages, will be best understood by reference to the following detailed description, taken in conjunction with the accompanying figures.

BRIEF DESCRIPTION OF THE DRAWING

For a more complete understanding of this invention reference should now be had to the embodiments illustrated in greater detail in the accompanying figures and described below by way of examples of the invention wherein.

DETAILED DESCRIPTION OF THE PREFERRED EMBODIMENT

In the following description, various operating parameters and components are described for one constructed embodiment. These specific parameters and components are included as examples and are not meant to be limiting.

While the present invention is described with respect to an apparatus for transmitting and receiving signals that are excited by multiple transverse electric modes, the present invention may be adapted to be used for various purposes including: a ground based terminal, a satellite, or any other communication device that uses feed horns.

Figure 1:
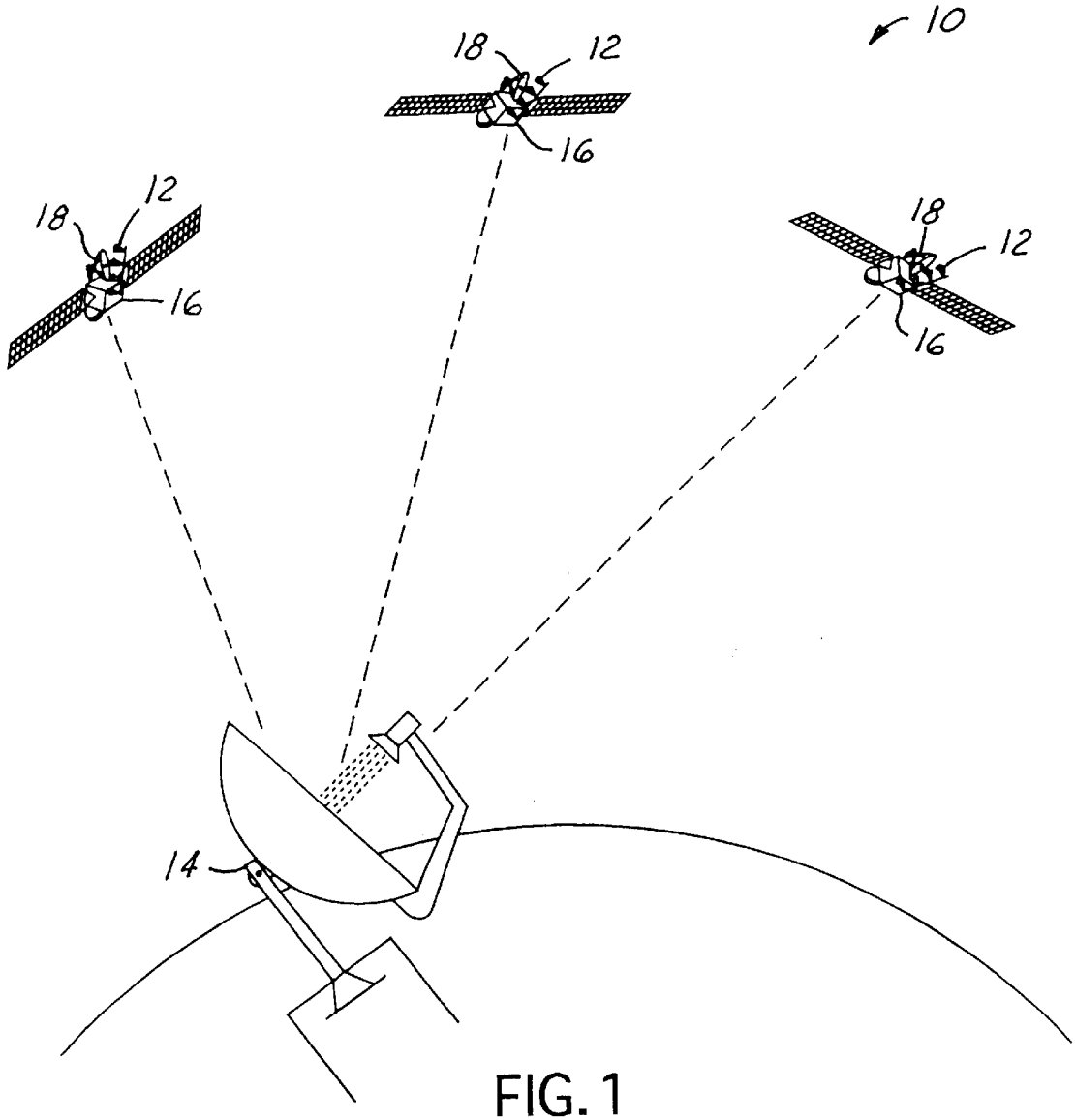
FIG. 1 is a perspective view of a satellite communication system implementing a multiple mode feed horn in accordance with an embodiment of the present invention.

Now referring to FIG. 1, a perspective view of a satellite communication system 10 implementing a multiple mode feed horn 12 in accordance with an embodiment of the present invention is shown. The satellite communication system 10 includes a ground-based station 14 and one or more satellite(s) 16. The satellite(s) 16 have a reflector 18 and one or more feed horn(s) 12. The feed horn 12 of the present invention feeds receive and transmit signals to and from the reflector 16 to the ground-based station 14 at various frequency bands including X, Ka, K, and Ku.

Figure 2:
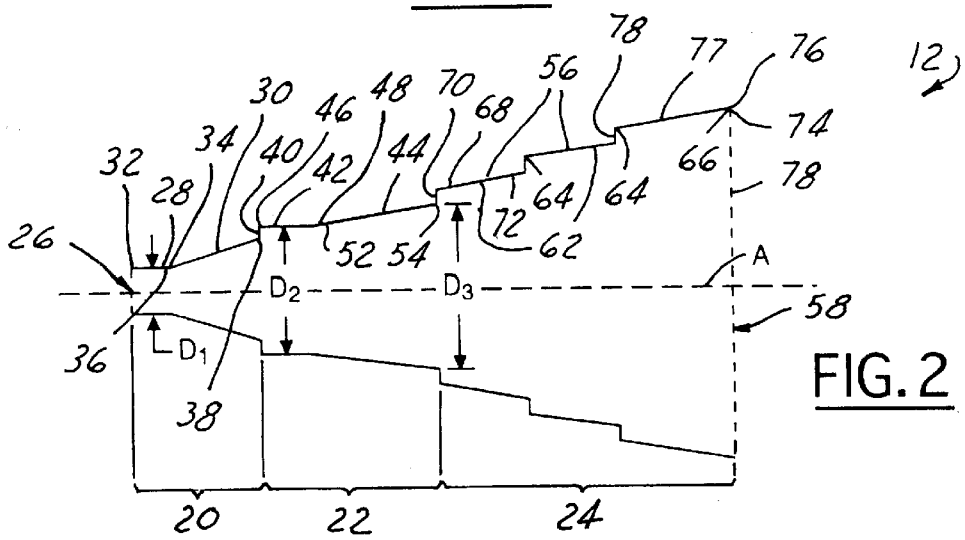
FIG. 2 is a cross-sectional view of the feed horn in accordance with an embodiment of the present invention.

Now referring to FIG. 2, a cross-sectional view of the feed horn 12 in accordance with an embodiment of the present invention is shown. The feed horn 12 has three main sections a traverse electric throat section 20, a traverse electric profile section 22, and a traverse electric aperture section 24. Although the throat section 20, profile section 22, and apertures section 24 are preferably part of a unitary integrated body forming the feed horn 12, as shown, they may be separate individual components that are fastened together using attachment mechanisms known in the art. The size and dimensions of the throat section 20, profile section 22, and apertures section 24 may vary depending upon application specific requirements. The feed horn 12 may be of various styles including circular, rectangular, both circular and rectangular, or square.

The throat section 20 input matches received signals as to prevent power loss and signal reflection. The throat section 20 includes an input end 26, first cylindrical section 28, and a first flared section 30. The first cylindrical section 28 has a first fore end 32 and a first aft end 34. The first flared section 30 has a first tapered end 36 and a first expanded end 38. The first tapered end 36 has the same inner diameter $D_1$ as the first aft end 34. The inner diameter of the first flared section 30 gradually expands at a certain angle relative to an axis of symmetry A. The long narrow shape of the first cylindrical section 28 in combination with the gradually expanding first flared section 30 provides directional signal propagation without reflection.

The profile section 22 has a structure as to excite a $TE_{12}$ mode, thereby allowing reception of signals in an approximate frequency band range from 14.0 GHz to 14.5 GHz. A TE mode is produced by introducing a step discontinuity at a cross-section of the feed horn 12 at which cutoff frequency is below the operating frequency of a desired signal. For example in a circular feed horn a first step discontinuity should be at a place where the diameter of the circular feed horn is about $1.7\lambda$, where $\lambda$ is the wavelength of the desired signal. For a rectangular feed horn, the first step should be at a location in the feed horn 12 where an H-plane dimension is about $1.5\lambda$.

The profile section 22 includes a first step 40, a second cylindrical section 42, and a second flared section 44. The first step 40 propagates a first TE mode and TM mode. The TM mode is canceled, as described below, by the aperture section 24. The second cylindrical section 42 has a second fore end 46, a second aft end 48, and an inner diameter $D_2$. Inner diameter $D_2$ is equal to the diameter of a first outer periphery 50 of the first step 40. The second flared section 44 has a second tapered end 52 and a second expanded end 54. The second tapered end 52 has an inner diameter that is equal to inner diameter $D_2$. The second expanded end 54 has an inner diameter $D_3$. The second flared section 44 expands at a certain angle from said second tapered end 52 to the second expanded end 54 relative to the longitudinal (axis of symetry) A. As with the first flared section 30, the second flared section 44 gradual expands to prevent reflections within the profile section 22. The gradual expansion of the second flared section 44 is also used for impedance matching of signals from the throat section 20 to the aperture section 24, which further prevents reflections within the feed horn 12.

The aperture section 24 has a structure as to excite a $TE_{12}$ mode, thereby allowing transmission of signals in an approximate frequency band range from 11.7 GHz to 12.2 GHz. The aperture section 24 has multiple flared steps 56 and an output end 58. Although the aperture section 24 as illustrated has three flared steps 56 any number of flared steps may be used. Each additional flared step generally excites an additional TE mode. The additional TE modes are used to obtain the desired amplitude and phase taper for both receive and transmit bands. Each flared step 56 has a flared step section 62 that has an inner diameter that expands from a tapered end 64 to an expanded end 66 relative to the axis A. A first flared step 68 has a second step 70 and a third flared section 72. The second step 70 has an inner diameter equal to $D_3$ and propagates a second TE mode. The second step 62 significantly cancels the TM mode excited by the first step 40 by exciting the same TM mode but 180° out-of-phase. Each additional flared step further cancels the TM mode. Furthermore, the flared steps 56 intensify the desired modes.

The inner periphery 74 of an expanded end 76 of a flared step 77 that is closest to the output end 58 defines a mouth 78 of the feed horn 12. Each additional flared step further expands the mouth 78 beyond that of each preceding flared step. The diameter of the mouth 78 may vary depending upon application design requirements. By varying the diameter of the mouth 78 the dimensions of other areas of the feed horn 12 may also vary in order to provide similar performance and efficiency characteristics.

The following TE modes have been found to provide high radiation efficiency between input and output of desired signals for the following stated feed horn styles. The preferable desired modes of the present invention using a circular horn style are $TE_{11}$, $TE_{12}$, $TE_{13}$, . . . and so on. The preferable desired modes using a rectangular horn style are $TE_{10}$, $TE_{30}$, $TE_{50}$, . . . and so on. When using a feed horn that is both circular and rectangular, the feed horn of the present invention has improved radiation efficiency when TE modes exist on the aperture section 24 versus when other modes exist on the aperture section 24. When TE mode amplitudes and phases are in desired proportions the feed horn of the present invention exhibits an increase in efficiency.

Figure 3:
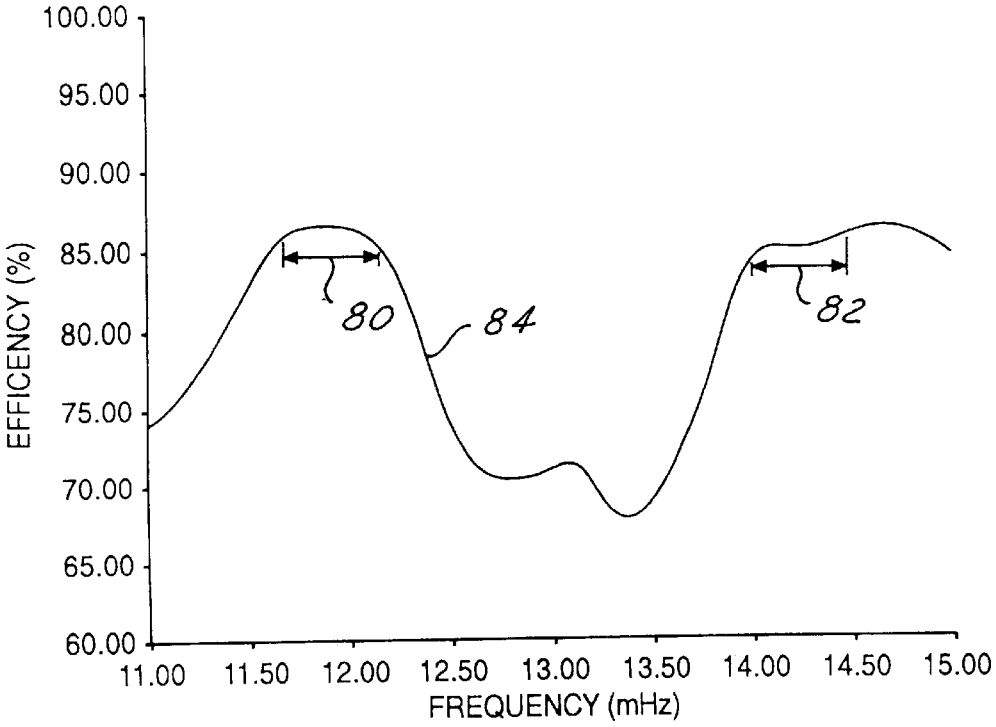
FIG. 3 is a graph of feed horn efficiency for both transmit and receive signals of the feed horn according to an embodiment of the present invention.

Now referring to FIG. 3, a graph of feed horn efficiency for both transmit and receive signals of the feed horn 12 according to an embodiment of the present invention is shown. Range 80 corresponds to approximate frequency levels at which transmit efficiency levels are highest. Range 82 corresponds to approximate frequency levels at which receive efficiency levels are highest. Note ranges 80 and 82 also correspond with the desired transmission frequencies. Therefore, feed horn 12 maximizes transmission of the desired signals and minimizes transmission of other signals. The feed horn 12 of the present invention potentially operates at efficiency levels above 85% as illustrated by curve 84, which is above operating efficiencies of traditional horns.

Figure 4:
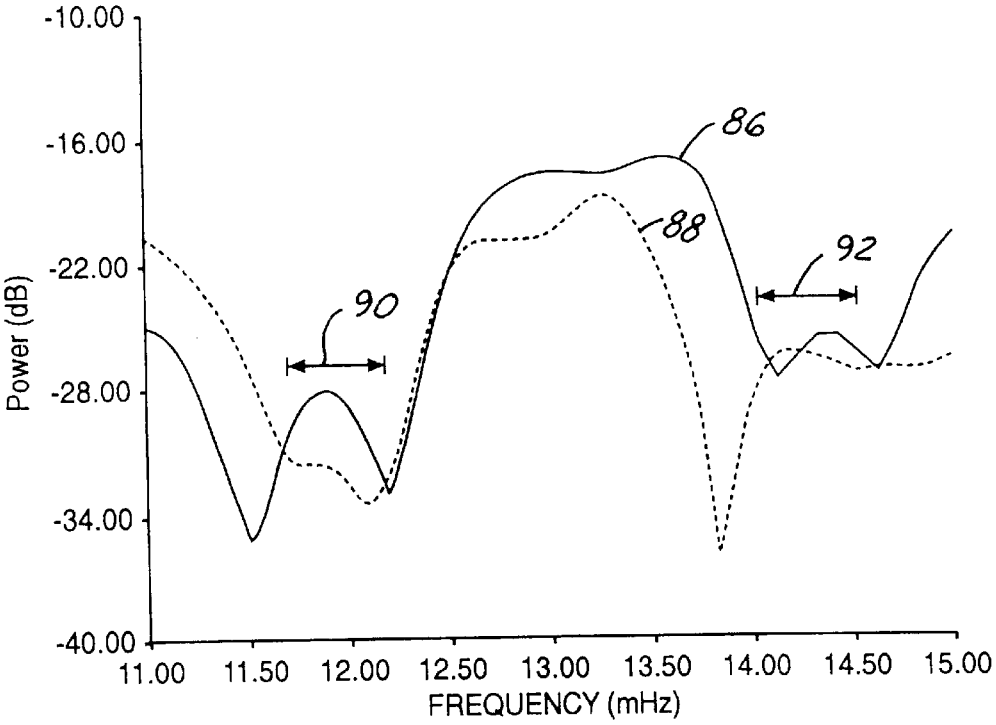
FIG. 4 is a graph of return loss and cross-polarization performance of the feed horn according to an embodiment of the present invention.

Now referring FIG. 4, a graph of return loss and cross-polarization performance of the feed horn 12 according to an embodiment of the present invention is shown. Curve 86 represents the return loss for both the transmit and receive signals. Curve 88 represents the cross-polarization levels for both the transmit and receive signals. Range 90 corresponds to approximate frequency levels at which transmit return loss and cross-polarization levels are lowest. Range 92 corresponds to approximate frequency levels at which receive return loss and cross-polarization levels are lowest. By maximizing return loss and minimizing cross-polarization levels for the desired transmission frequencies the feed horn 12 provides an efficient medium for signal transmission without interference. The return loss is better than 28 db in the transmit band and better than 26 db in the receive band. The cross-polarization levels were obtained within a 15° angle from the axis A.

Figure 5A:
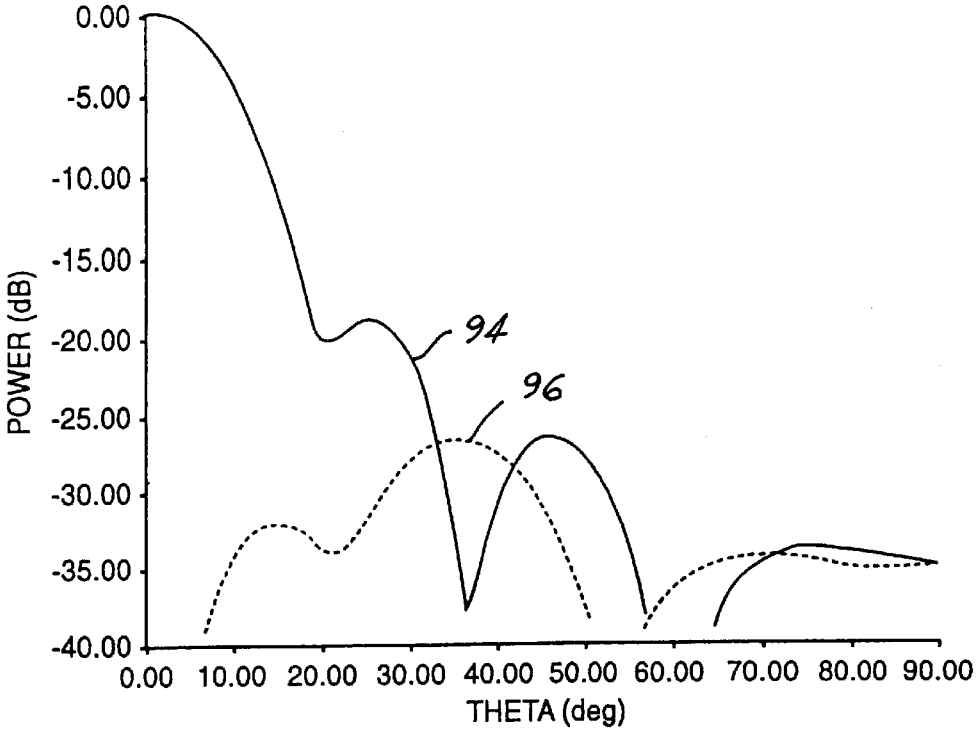
FIG. 5A is a graph of a radiation pattern illustrating co-polarization and cross-polarization levels for the transmit band of the feed horn according to an embodiment of the present invention.
Figure 5B:
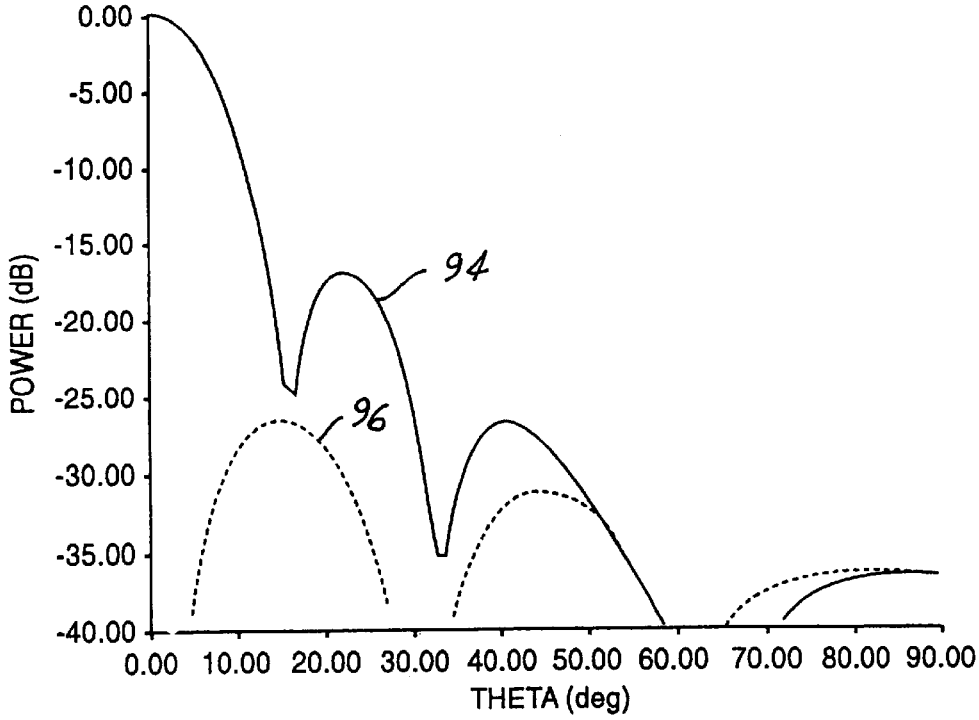
FIG. 5B is a graph of a radiation pattern illustrating co-polarization and cross-polarization levels for the receive band of the feed horn according to an embodiment of the present invention.

Now referring to FIGS. 5A and 5B, graphs of radiation patterns illustrating co-polarization levels and cross-polarization levels for the transmit and receive bands of the feed horn 12 according to an embodiment of the present invention are shown. The co-polarization levels and the cross-polarization levels are for mid-band frequencies within the transmit and receive bands. FIG. 5A illustrates co-polarization and cross-polarization levels for a transmission frequency of 11.95 GHz. FIG. 5B illustrates co-polarization and cross-polarization levels for a transmission frequency of 14.25 GHz. The co-polarization levels are represented by curve 94 and the cross-polarization levels are represented by curves 96. Curve 94 represents the normalized copolar pattern. The co-polarization and cross-polarization levels are plotted in relation to theta (θ) holding phi(Φ) constant at 45°. Phi and theta are spherical coordinate angles corresponding to a cross-sectional plane within the feed horn 12 and along axis A.

The feed horn 12 of the present invention has a desired radiation pattern, by focusing the transmission of signals along the axis A, where theta is equal to 0°. Side lobes are approximately 19 db and 17 db below a desired electric field polarization (co-polarization) peak for the transmit and receive bands respectively.

The feed horn of the present invention by providing a structure within a certain general shape provides a feed horn that minimizes propagation of TM modes, while at the same time propagating TE modes. Therefore, providing a feed horn that eliminates the size constraints of the prior art and has dual band functionality. The reduction in size of the feed horn also reduces the amount of material required to produce the feed horn, thereby reducing production costs and weight of the feed horn. The structured design of the present invention also provides increased efficiency by focusing propagation capabilities to TE modes.

The above-described apparatus, to one skilled in the art, is capable of being adapted for various purposes and is not limited to the following applications: a ground based terminal, a satellite, or any other communication device that uses feed horns. The above-described invention may also be varied without deviating from the spirit and scope of the invention as contemplated by the following claims.

What is claimed is:

1. A multiple mode feed horn for transmitting and receiving signals comprising:

a throat section having an input end, said throat section comprising:

a first cylindrical section having a first fore end and a first aft end; and a first flared section having a first tapered end and a first expanded end;

said first tapered end is coupled to said first aft end;

a profile section comprising:

a first step coupled to said first expanded end, said first step propagating a first transverse electric (TE) mode;

a second cylindrical section having a second fore end and a second aft end, said second fore end is coupled to said first step; and a second flared section having a second tapered end and a second expanded end, said second tapered end coupled to said second aft end; and an aperture section having an output end, said aperture section comprising:

a first flared step having a third step coupled to a third flared section, said third step is coupled to said second expanded end;

said first flared step propagating a second TE mode; and a mouth defined by an inner diameter of said output end.

2. A feed horn as in claim 1 wherein the feed horn minimizes the propagation of transverse magnetic modes.

3. A feed horn as in claim 1 wherein said aperture section further comprises:

a second flared step coupled to said first flared step; and a third flared step coupled to said second flared step;

said second flared step and said third flared step propagate a third TE mode and a fourth TE mode respectively.

4. A feed horn as in claim 3 wherein said second flared step and said third flared step further expand said mouth beyond that of said first flared step.

5. A feed horn as in claim 1 that transmits and receives signals in bands selected from the group consisting of: Ku band, Ka band, and X band.

6. A feed horn as in claim 1 wherein said throat section input matches a desired TE mode as to minimize reflection of electromagnetic waves.

7. A feed horn as in claim 1 wherein said profile section minimizes reflection of electromagnetic waves.

8. A multiple mode feed horn for transmitting and receiving signals comprising:

a transverse electric throat section;

a transverse electric profile section having a first step propagating a first transverse electric (FE) mode and a first transverse magnetic (TM) mode; and a transverse electric aperture section having a second step propagating a second transverse electric (TE) mode and a second transverse magnetic (TM) mode canceling the first (TM) mode;

wherein said multiple mode feed horn minimizes the propagation of transverse magnetic modes.

9. A feed horn as in claim 8 wherein said transverse electric throat section comprises:

a first cylindrical section that has a first fore end and a first aft end; and a first flared section that has a first tapered end and a first expanded end;

said first tapered end is coupled to said first aft end.

10. A feed horn as in claim 8 wherein said transverse electric throat section input matches a desired TE mode as to minimize reflection of electromagnetic waves.

11. A feed horn as in claim 8 wherein said transverse electric profile section comprises:

a second cylindrical section mat has a second fore end and a second aft end, said second fore end is coupled to said first step; and a second flared section that has a second tapered end and a second expanded end, said second tapered end is coupled to said second aft end.

12. A feed horn as in claim 8 wherein said transverse electric aperture section comprises:

a third step coupled to a third flared section, said first flared step propagates a second TE mode; and an output end that has an inner diameter that defines a mouth.

13. A multiple mode feed horn for transmitting and receiving signals comprising:

a throat section having an input end, said throat section comprising:

a first cylindrical section having a first fore end and a first aft end;

a first flared section having a first tapered end and a first expanded end;

said first tapered end is coupled to said first aft end;

a profile section comprising:

a first step coupled to said first expanded end, said first step propagating a first transverse electric (TE) mode;

a second cylindrical section having a second fore end and second aft end, said second fore end is coupled to said first step; and a second flared section having a second tapered end and a second expanded end, said second tapered end coupled to said second aft end; and an aperture section having an output end, said aperture section comprising:

a first flared step having a third step coupled to a third flared section, said third step is coupled to said second expanded end;

said first flared step propagating a second TE mode; and a mouth defined by an inner diameter of said output end;

said multiple mode feed horn preventing the propagation of transverse magnetic modes.

14. A multiple mode feed horn for transmitting and receiving signals having an axis of symmetry, said feed horn comprising:

a throat section having an input end, said throat section comprising:

a first cylindrical section having a first fore end and a first aft end, said first aft end having a first inner diameter;

a first flared section having a first tapered end and a first expanded end, said first tapered end having an inner diameter equal to said first inner diameter and coupled to said first aft end;

said first flared section expanding at a certain angle from said first tapered end to said first expanded end relative to the axis of symmetry;

a profile section comprising:

a first step coupled to said first expanded end, said first step propagating a first transverse electric (TE) mode;

a second cylindrical section having a second fore end, second aft end, and a second inner diameter that is equal to a diameter of a first outer periphery of said first step and is coupled to said first step; and a second flared section having a second tapered end and a second expanded end, said second tapered end having an inner diameter equal to said second inner diameter and coupled to said second aft end;

said second expanded end having a third inner diameter;

said second flared section expanding at a certain angle from said second tapered end to said second expanded end relative to the axis of symmetry; and an aperture section having an output end, said aperture section comprising:

a first flared step having a second step coupled to a third flared section, said second step having an inner diameter equal to said third inner diameter and is coupled to said second expanded end;

said third flared section expanding in diameter at a certain angle from said second step toward said output end relative to the axis of symmetry;

said first flared step propagates a second TE mode; and a mouth defined by an inner diameter of said output end;

said multiple mode feed horn preventing the propagation of transverse magnetic modes.

15. A feed horn as in claim 14 wherein said aperture section further comprises additional flared steps coupled in series to each other and said first flared step, each additional flared step propagates an additional TE mode.

16. A feed horn as in claim 15 wherein each additionally coupled flared step further expands at a specified angle from an inner diameter of an expanded end of a preceding flared step to an expanded end of said additionally coupled flared step relative to the axis of symmetry A.

17. A feed horn as in claim 14 that transmits and receives signals in bands selected from the group consisting of: Ku band, Ka band, and X band.

18. A feed horn as in claim 14 wherein said throat section input matches a desired TE mode as to minimize reflection of electromagnetic waves.

19. A feed horn as in claim 14 wherein said profile section minimizes reflection of electromagnetic waves.

* * * * *

UNITED STATES PATENT AND TRADEMARK OFFICE

CERTIFICATE OF CORRECTION

PATENT NO. : 6,642,900 B2
DATED : November 4, 2003
INVENTOR(S) : Arun Bhattacharyya and Daniel H. Roper It is certified that error appears in the above-identified patent and that said Letters Patent is hereby corrected as shown below:

Columm 6,
Line 44, "(FE)" should be -- (TE) --
Line 65, "mat" should be -- that --

Signed and Sealed this

Ninth Day of March, 2004

JON W. DUDAS
*Acting Director of the United States Patent and Trademark Office*